US011390986B2

(12) United States Patent
Lomonaco et al.

(10) Patent No.: US 11,390,986 B2
(45) Date of Patent: Jul. 19, 2022

(54) METHOD AND DEVICE FOR DEPOSITING A COATING ON AN ENDLESS FIBER

(71) Applicant: SAFRAN CERAMICS, Le Haillan (FR)

(72) Inventors: Clément Lomonaco, Moissy-Cramayel (FR); Damien Cazaubon, Moissy-Cramayel (FR)

(73) Assignee: SAFRAN CERAMICS, Le Haillan (FR)

( * ) Notice: Subject to any disclaimer, the term of this patent is extended or adjusted under 35 U.S.C. 154(b) by 0 days.

(21) Appl. No.: 17/051,629

(22) PCT Filed: May 3, 2019

(86) PCT No.: PCT/FR2019/051017

§ 371 (c)(1),
(2) Date: Oct. 29, 2020

(87) PCT Pub. No.: WO2019/220033

PCT Pub. Date: Nov. 21, 2019

(65) Prior Publication Data

US 2021/0230794 A1 Jul. 29, 2021

(30) Foreign Application Priority Data

May 15, 2018 (FR) ..... 1854041

(51) Int. Cl.
*D06M 10/00* (2006.01)
*D06M 10/06* (2006.01)

(52) U.S. Cl.
CPC ..... *D06M 10/005* (2013.01); *D06M 10/06* (2013.01)

(58) Field of Classification Search
CPC .... B05D 3/007; B05D 3/0254; B05D 3/0263; B05D 3/06; B05D 3/061; B05D 3/065;
(Continued)

(56) References Cited

U.S. PATENT DOCUMENTS 4,446,169 A 5/1984 Castle et al.
5,302,265 A * 4/1994 Dalzell, Jr. ..... C25D 13/02 204/491

(Continued)

FOREIGN PATENT DOCUMENTS

CH 670 105 A5 5/1989
DE 44 43 471 A1 6/1996

(Continued)

OTHER PUBLICATIONS

English Machine Translation of DE4443471A1. (Year: 1996).*
International Search Report as issued in International Patent Application No. PCT/FR2019/051017, dated Jun. 28, 2019.

*Primary Examiner* — Michael P Wieczorek
(74) *Attorney, Agent, or Firm* — Pillsbury Winthrop Shaw Pittman LLP

(57) ABSTRACT

A method for depositing a coating on a continuous carbon or ceramic fiber from a precursor of the coating, the method including at least the heating of at least one segment of the fiber in the presence of a liquid or supercritical phase of the coating precursor by a laser beam so as to bring the surface of the segment to a temperature allowing the formation of the coating on the segment from the coating precursor.

8 Claims, 2 Drawing Sheets

(58) Field of Classification Search
CPC .... B05D 3/067; D06M 10/005; D06M 10/06; C04B 41/50; C04B 41/5002; C04B 41/5006; C03C 25/10; C03C 25/44; C03C 25/1062
See application file for complete search history.

(56) References Cited

U.S. PATENT DOCUMENTS

| | | | | |
|---|---|---|---|---|
| 8,314,408 | B2 * | 11/2012 | Hartsuiker | B05D 3/067 250/492.1 |
| 2018/0304304 | A1 * | 10/2018 | Moore | C03C 25/1065 |

FOREIGN PATENT DOCUMENTS

| | | | | |
|---|---|---|---|---|
| DE | 4443471 | A1 * | 6/1996 | D01F 11/14 |
| DE | 10 2015 205595 | B3 | 3/2016 | |
| EP | 2 154 119 | A1 | 2/2010 | |

* cited by examiner

METHOD AND DEVICE FOR DEPOSITING A COATING ON AN ENDLESS FIBER

CROSS-REFERENCE TO RELATED APPLICATIONS

This application is the U.S. National Stage of PCT/FR2019/051017, filed May 3, 2019, which in turn claims priority to French patent application number 1854041 filed May 15, 2018. The content of these applications are incorporated herein by reference in their entireties.

BACKGROUND OF THE INVENTION

The present invention relates to the general field of methods for depositing a coating on fibers, and more particularly on a continuous carbon or ceramic fiber from a precursor of the coating. The invention also relates to a device suitable for the implementation of such a method.

Ceramic-matrix composite (CMC) materials, known for their good mechanical properties that make them able to constitute structural elements and for preserving these properties at high temperatures, constitute a viable alternative to the traditional metal parts. Their reduced mass compared to their metal equivalent makes them choice parts to address the problems in increasing the efficiency and reducing the polluting emissions of engines in the aeronautical field.

The parts made of CMC material comprise generally continuous fiber reinforcement in the form of a woven textile, which is densified by a ceramic matrix. The fiber reinforcement thus comprises continuous fibers, generally grouped together in the form of yarns or strands, the orientation of which can be adapted to the main directions of stress on the part during its use. The preform intended to form the fiber reinforcement can be woven from the strands of continuous fibers at the dimensions of the part (for example by two-dimensional or three-dimensional weaving loom), using a suitable weaving loom. In order to make a CMC-material part which has improved mechanical properties, it is known to have fibers in the fiber preform that are coated with an interphase, prior to the densification of the preform.

The deposition of an interphase coating on the fibers of a fiber preform already woven by Chemical Vapor Infiltration (CVI) is known. This technique is costly in terms of energy, in particular due to the hot walls traditionally used to bring the reaction enclosure to a temperature allowing the formation of the interphase. In addition, a large amount of precursor is required to form the interphase because part of it is deposited on the walls of the reaction enclosure and is permanently lost. In addition, the interphase is not formed uniformly throughout the preform, which is not desirable.

There is therefore a need for a method for depositing a coating on a continuous carbon or ceramic fiber which does not have the aforementioned drawbacks.

OBJECT AND SUMMARY OF THE INVENTION

The present invention therefore mainly aims at overcoming such drawbacks by proposing a method for depositing a coating on a continuous carbon or ceramic fiber from a precursor of the coating, the method comprising at least the heating of at least one segment of the fiber in the presence of a liquid or supercritical phase of the coating precursor by a laser beam so as to bring the surface of the segment to a temperature allowing the formation of the coating on the segment from the coating precursor.

A "fiber segment" here corresponds to a certain fiber length, in other words, the segment extends according to the length or to the greatest dimension of the fiber. A fiber segment is thus a portion of the fiber of non-zero length. Since a fiber can comprise several filaments, a fiber segment can comprise several filaments. In the present disclosure, by "surface of the segment" is meant the surface of each filament that makes up the fiber segment, if necessary. Similarly, by "depositing" or "forming" a coating on the fiber segment is meant the deposition or the formation of the coating on the surface of each filament that makes up the fiber segment, if necessary. When the fiber segment is heated in the presence of a precursor in the liquid state, it is also referred to as a calefaction deposition.

The method according to the invention is remarkable in particular by the fact that a segment of the fiber is heated directly and locally using a laser beam. This local heating of the fiber allows reducing the energy consumption of the whole method compared to methods of the Chemical Vapor Infiltration type in an enclosure whose walls are heated. The local laser heating also allows significantly increasing the reproducibility of the method, the kinetics of the formation of the coating and its homogeneity. The method further allows reducing the required amount of precursor since the heated fiber segment only needs to be in the presence of the precursor in the liquid or supercritical phase.

The method according to the invention is advantageous in that it is possible to choose the properties or characteristics of the laser beam, in particular its shape, its wavelength or its power, in order to further improve the kinetics of deposition and to adapt it to the fiber material and/or to the precursor. The shape of the beam can for example be chosen to focus the energy on a more or less large segment of the fiber. The wavelength of the laser beam can for example be chosen as a function of a maximum absorption wavelength of the material of the fiber. The wavelength of the laser beam can for example be chosen as a function of an activation wavelength of the precursor in the liquid or supercritical state, that is to say of a wavelength where the precursor absorbs energy from the laser beam, thus facilitating the formation of the coating. The laser beam can be continuous or pulsed at a certain pulse frequency. In the case of a deposition from the precursor in the supercritical phase, the local laser heating allows controlling the temperature conditions at the fiber segment, and switching for example the precursor to the supercritical state only in the vicinity of the concerned fiber segment. The heating with a laser beam can be used alone or in addition to traditional heating means.

In an exemplary embodiment, the method can further comprise the travel of the fiber in front of the laser beam so as to form the coating on several successive fiber segments. In this case, the travel of the fiber can be performed continuously or semi-continuously, depending on the kinetics of depositions inherent in the variants described above as well as in the precursors involved. This disposition allows carrying out the deposition continuously, which makes the method easy to implement.

In an exemplary embodiment, several distinct fiber segments can be heated simultaneously by several laser beams. Thus, it is possible for example to use laser beams having different characteristics, for example to promote the absorption of the beam by the fiber and/or the activation of the precursor, and this at different locations of the fiber. This disposition allows carrying out the deposition at several locations of the fiber simultaneously, which increases the kinetics of the deposition and can allow a faster travel of the fiber, if necessary. It is also possible to make temperature gradients along the fiber in order to control the properties of the coating such as its crystallinity.

In an exemplary embodiment, a segment of the fiber can be heated by several laser beams angularly distributed around said segment. This deposition allows further improving the homogeneity and the kinetics of the deposition on the fiber by ensuring regular and uniform heating over the entire surface of the heated fiber segment.

In an exemplary embodiment, the coating can be an interphase coating. The fiber coated with an interphase can then be used for the manufacture of a part made of CMC material, for example by weaving them (two-dimensional or three-dimensional weaving for example) to obtain a preform which will then be at least partially densified by a ceramic matrix such as silicon carbide. In this situation, the interphase has a function of releasing the embrittlement of the composite material that promotes the deflection of possible cracks reaching the interphase after having propagated in the matrix, preventing or delaying the rupture of fibers by such cracks. This interphase also allows protecting the fiber of the material of the matrix during its formation.

In an exemplary embodiment, the coating can comprise a material chosen among the following elements: silicon carbides (SiC), pyrocarbon (PyC), doped or undoped boron nitrides (BN, BN(Si)), doped or undoped silicon nitrides (SiN, $Si_3N_4$, $Si_xN_yO_z$), boron carbides ($B_4C$, BC), and mixtures thereof.

In an exemplary embodiment, the fiber can be made of silicon carbide. Particularly, the material of the silicon carbide fiber can have an oxygen content of less than or equal to 1% in atomic percentage. For example, such a fiber can be a Hi-Nicalon type S fiber marketed by the Japanese company NGS.

The invention also relates, according to a second aspect, to a device for implementing a method for depositing a coating on a continuous fiber from a precursor of the coating in the liquid phase, the device comprising a tubular reactor having a U-shaped section to contain the fiber and the precursor of the coating in the liquid phase, a laser source to generate a laser beam in the reactor intended to heat the surface of a segment of the fiber in the presence of the precursor of the coating in the liquid phase, and a device for making the fiber travel inside the reactor. The U-shape of the reactor section allows it to contain the coating precursor in the liquid state while ensuring good immersion of the fiber in the coating precursor. The device is advantageously adapted to deposit the coating on the fiber continuously using the travel device.

In an exemplary embodiment, the travel device may comprise a first mandrel from which the fiber is intended to be unwound, and a second mandrel on which the coated fiber is intended to be wound.

In an exemplary embodiment, the laser source can be configured to generate at least two laser beams at two distinct locations in the reactor.

In an exemplary embodiment, the device can comprise at least two laser sources configured to generate respectively at least two laser beams at two distinct locations in the reactor.

In an exemplary embodiment, the device can comprise several laser sources angularly distributed around the reactor to generate laser beams crossing each other inside the reactor.

BRIEF DESCRIPTION OF THE DRAWINGS

Other characteristics and advantages of the present invention will emerge from the description given below, with reference to the appended drawings which illustrate exemplary embodiments thereof without any limitation. In the figures.

DETAILED DESCRIPTION OF THE INVENTION

Figure 1:
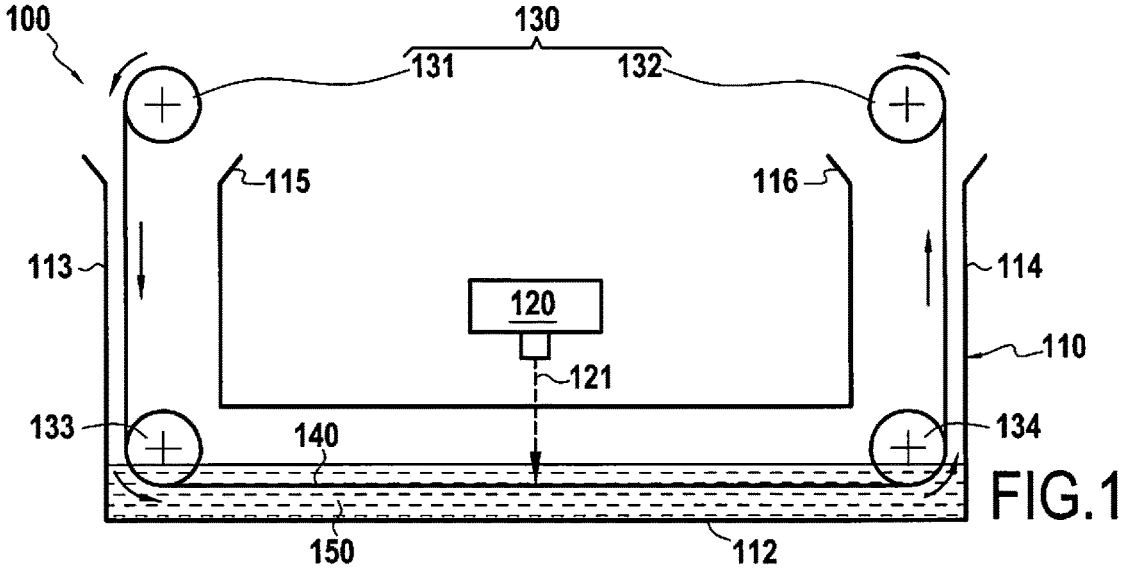
FIGS. 1 to 5 schematically illustrate variants of devices for implementing a method for depositing a coating on a continuous fiber from a precursor of the coating in the liquid phase, and FIG. 6 schematically illustrates a device for implementing a method for depositing a coating on a continuous fiber from a precursor of the coating in the supercritical phase.

FIG. 1 shows a device 100 for the implementing a method according to a first embodiment of the invention. The device 100 allows implementing a method for depositing a coating by calefaction, that is to say in which the formation of the coating is carried out in the presence of a liquid phase of a precursor of the coating. The device 100 comprises a tubular reactor 110, a laser source 120, and a travel device 130. A continuous fiber 140 made of ceramic or carbon as well as a precursor 150 of the coating in the liquid state, are present in the reactor 110.

The tubular reactor 110 has a U-shaped section capable of containing a coating precursor in the liquid state 150 while allowing the formation of the coating by a method according to the invention. More specifically, the reactor 110 comprises a low (here straight and horizontal) portion 112 and two vertical (here also straight) portions 113 and 114 which extend from the low portion 112. In the example illustrated, the coating precursor 150 is present in the low portion 112 of the reactor. The reactor 110 here comprises a first opening 115 and a second opening 116 respectively at the ends of the vertical portions 113 and 114. The fiber 140 runs through the entire reactor 110 between the openings 115 and 116, and is immersed in the coating precursor 150 at the low portion 112 of the reactor. The reactor 110 can comprise means (not represented) for filling and/or purging the coating precursor 150. The reactor 110 may have a tube section which is circular or which has other shapes.

The laser source 120 allows generating a laser beam 121 inside the reactor 110. In this example, the laser source 120 is located above the low portion 112 of the reactor 110, outside the latter. The laser beam 120 is directed towards the fiber 140 present in the reactor 110. Of course, other configurations of the reactor 110 and of the laser source 120 can be envisaged, as long as the laser beam 121 allows heating the fiber 140 in the presence of the coating precursor 150. The laser beam 121 can have various shapes and for example form a point or "spot", or a more extended shape so as to cover a larger fiber segment.

Those skilled in the art know how to determine the characteristics of the laser beam 121 necessary to ensure the formation of the coating on the fiber 140, in particular by modifying the focusing, the power of the laser source 120 or the wavelength of the laser beam 121. Particularly, those skilled in the art will adapt the characteristics of the laser beam 121 as a function of the material constituting the fiber 140 and of the coating precursor 150 used.

The reactor 110 can be advantageously made of a material transparent to the laser beam 121 generated by the laser source 120 such that the laser beam 121 can reach a location inside the reactor 110 and meet the fiber 140 with a view to heating it. The laser source 120 may, in an exemplary embodiment not illustrated, be inside the reactor 110.

The travel device 130 here includes a first mandrel 131 from which the fiber 140 can be unwound, the first mandrel 131 can be a mandrel for storing the fiber 150 before it is coated, and a second mandrel 132 on which the fiber 150 can be wound once coated. The fiber 150 can thus circulate in the reactor 110 from the first mandrel 131 up to the second mandrel 132. The centering elements 133, 134 of the fiber 150 in the reactor 120 here ensure that the fiber 150 does not touch the wall of the reactor 120 and that it is sufficiently tensioned. The travel device 130 can be controlled by control means not represented, so as to make the fiber 150 travel in the device 100 continuously or semi-continuously (that is to say step by step). The travel device 130 can for example make the fiber 150 travel in the device 100 in both directions.

Figure 2:
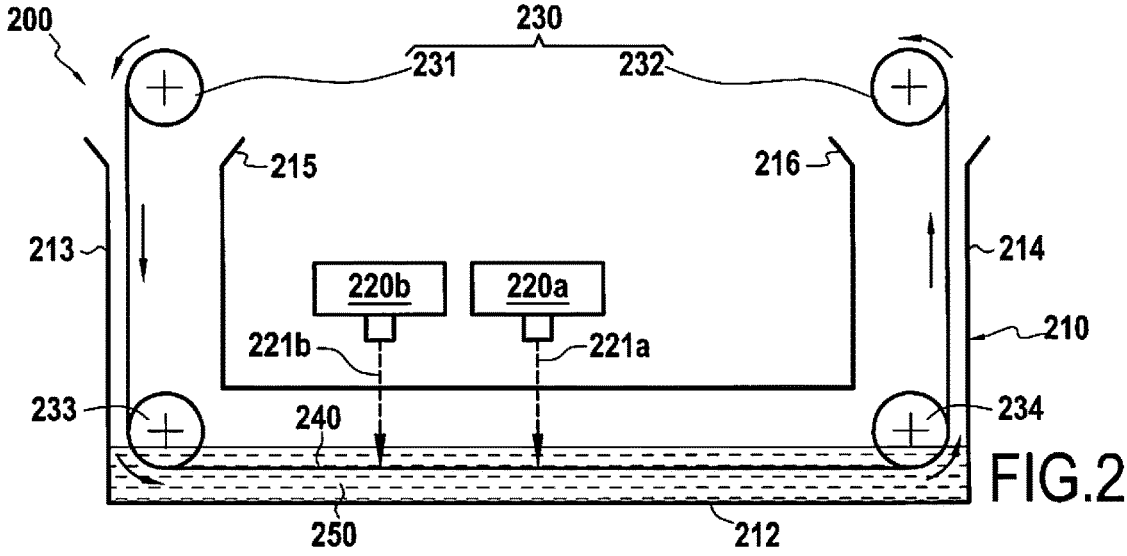

A device 200 according to a second embodiment of the invention is represented in FIG. 2. Unless otherwise indicated, the corresponding reference signs between FIGS. 1 and 2 (100 becomes 200) designate identical characteristics.

The device 200 still comprises a first laser source 220*a* for generating a beam 221*a*. Compared to the device 100, the device 200 further comprises a second laser source 220*b* for generating a second laser beam 221*b* at another location in the reactor 210. More specifically, the second laser beam 221*b* allows heating a segment of the fiber 240 distinct from the fiber segment heated by the first laser beam 221*a* coming from the first laser source 220*a*. Such a device 200 is advantageous in that it allows increasing the kinetics of deposition of the coating because the two laser sources 220*a* and 220*b* can operate simultaneously. It also allows using two laser beams 221*a* and 221*b* having different characteristics.

Figure 3:
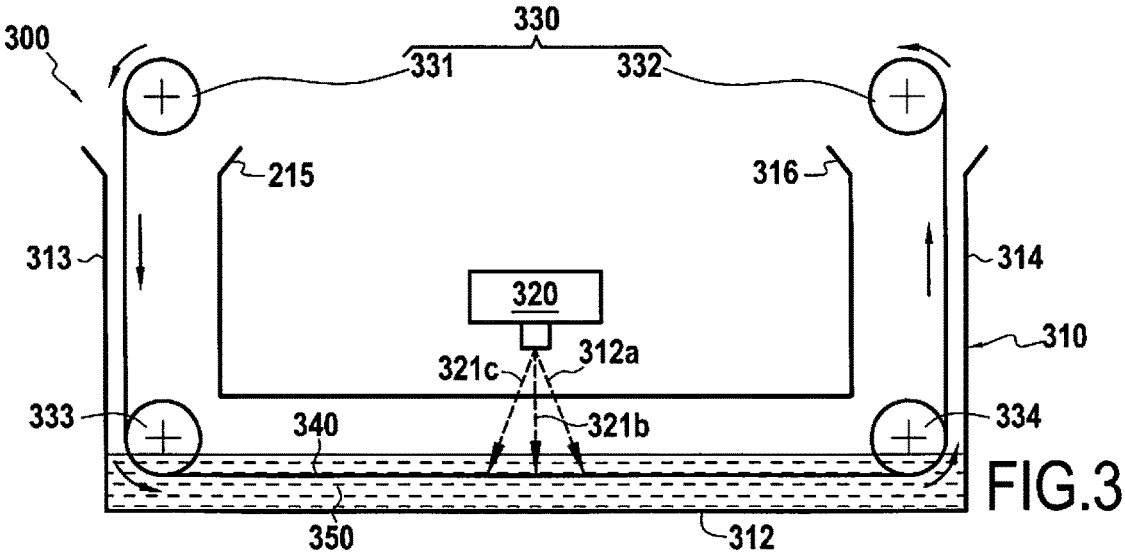

A device 300 according to a third embodiment of the invention is represented in FIG. 3. Unless otherwise indicated, the corresponding reference signs between FIGS. 1 and 3 (100 becomes 300) refer to identical characteristics.

The device 300 still comprises a laser source 320, placed in the same way as the laser sources 120 and 220*a* with respect to the reactor 310. With respect to the device 100, the laser source 320 is configured to generate several laser beams 321*a*, 321*b*, 321*c* in the direction of the fiber 340. More specifically, the laser beams 321*a*-321*c* allow here heating several distinct segments of the fiber 340 simultaneously. The laser beams 321*a*-321*c* follow here different paths converging at the laser source 320. Such a device 300 is advantageous in that it also allows increasing the kinetics of deposition of the coating.

Figure 4:
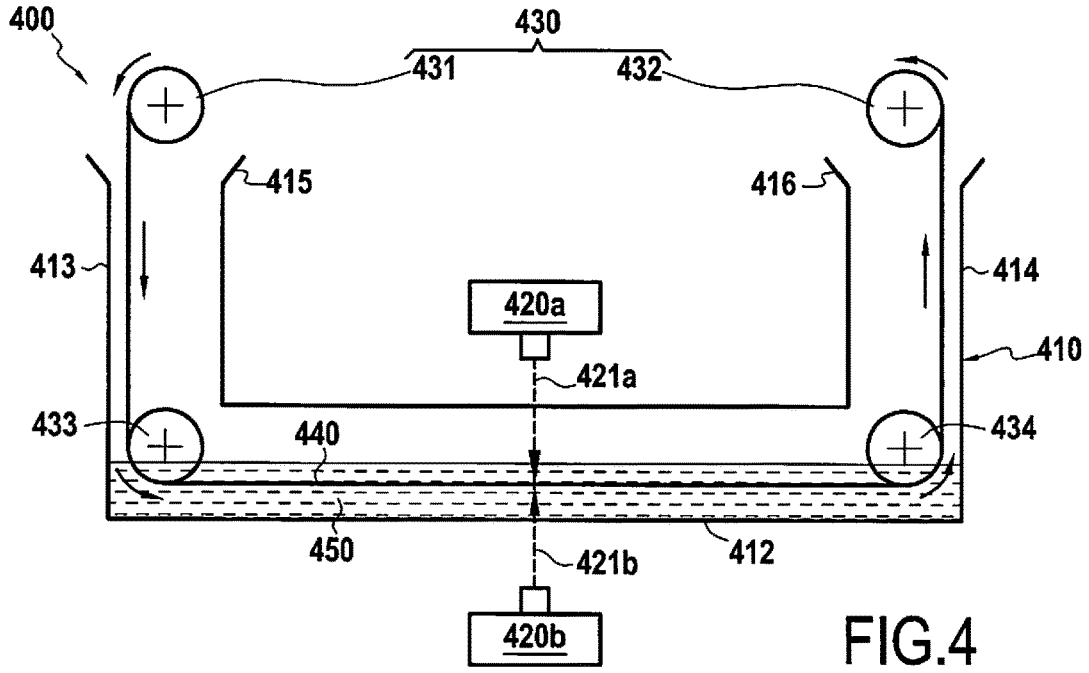

A device 400 according to a fourth embodiment of the invention is represented in FIG. 4. Unless otherwise indicated, the corresponding reference signs between FIGS. 1 and 4 (100 becomes 400) designate identical characteristics.

The device 400 here comprises a first laser source 420*a*, placed in the same way as the laser sources 120, 220*a* and 320 with respect to the reactor 410, and a second laser source 420*b* located opposite the first laser source 420*a* with respect to the reactor 410. The laser beams 421*a* and 421*b* generated by each of the laser sources 420*a* and 420*b* cross each other at the fiber 440 and the directions that carry their paths are coincident. In this example, the laser sources 420*a* and 420*b* (as well as the beams 421*a* and 421*b*) are angularly distributed around the reactor 410, and are thus angularly separated by 180°. This disposition allows heating the fiber uniformly and thus obtaining a homogeneous deposition, while increasing the kinetics of the deposition.

Figure 5:
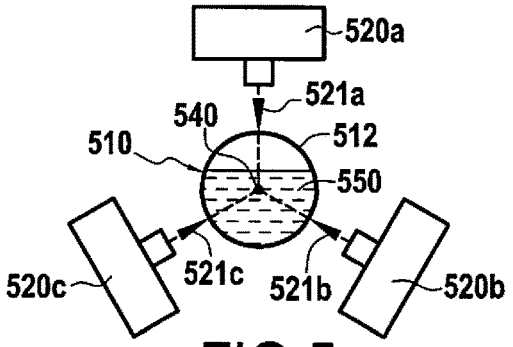

A device 500 according to a fifth embodiment of the invention is represented in section in FIG. 5. Unless otherwise indicated, the corresponding reference signs between FIGS. 1 and 5 (100 becomes 500) designate identical characteristics.

FIG. 5 only shows a cross section of the low portion 512 of the reactor 510, on which three laser sources 520*a*-520*c* can be seen to generate respectively three laser beams 521*a*-521*c* which cross each other at the fiber 540 immersed in the coating precursor 550. The three laser sources 520*a*-520*c* are angularly distributed around the low portion 512 of the reactor 510, and are thus angularly separated by 120°. As for the device 400, this disposition allows heating the fiber more uniformly and thus obtaining a homogeneous deposition, while increasing the kinetics of the deposition.

The devices 100, 200, 300, 400 and 500 described above allow implementing a method for depositing a coating on a continuous carbon or ceramic fiber from a precursor of the coating, in which at least one segment of the fiber is heated in the presence of a precursor of the coating in the liquid state (calefaction). The aforementioned devices are equipped with travel devices that allow carrying out the method continuously that is to say by repeating successively the heating step on consecutive segments of the fiber.

Figure 6:
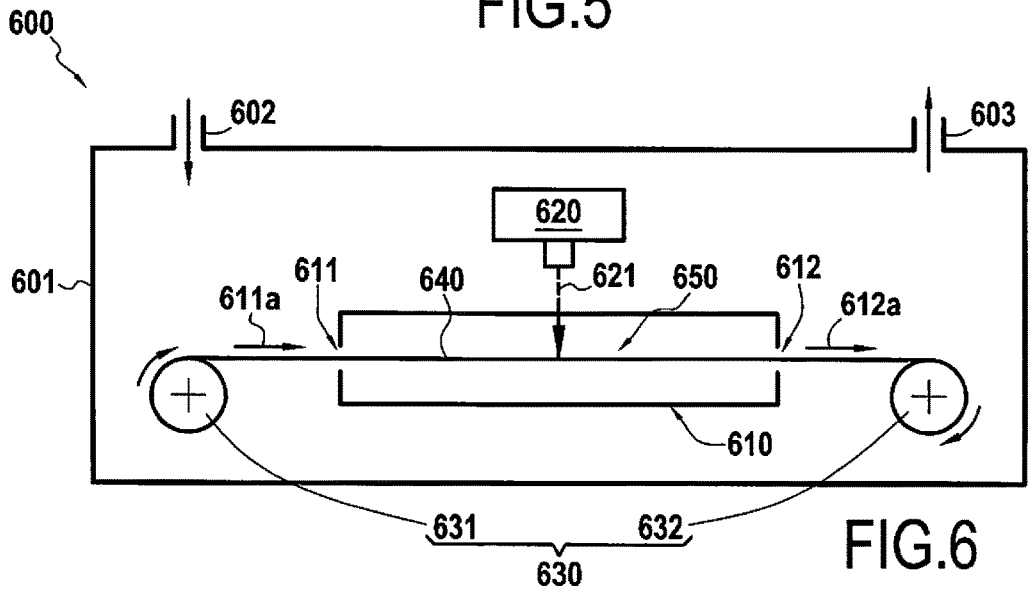

FIG. 6 shows a device 600 for implementing a similar deposition method, but in which the precursor of the coating is in the supercritical state.

The device 600 comprises an enclosure 601 provided with an inlet port 602 and with an outlet port 603. A neutral gas (for example argon) can be introduced into the enclosure 601 through the inlet port. 602. The outlet port 603 allows recovering the gas mixture which has circulated in the enclosure 601 so as not to let it escape into the external environment.

A reactor 610 is present inside the enclosure 601. The reactor 610 here takes the general shape of a rectilinear tube open at its ends. More specifically, the reactor 610 comprises an inlet opening 611 and an outlet opening 612 through which the continuous fiber 640 can respectively enter and exit the reactor 610. A precursor of the coating consisting of a gas or gas mixture is also introduced into the reactor 610 through the inlet opening 611 (arrow 611*a*) and discharged from the reactor through the outlet opening 612 (arrow 612*a*). A laser source 620 is also present to generate a laser beam 621 in the reactor at a location thereof where the fiber 640 is present, similarly to the devices described above. A travel device 630 may be present in the enclosure to ensure the displacement of the fiber 640 in the reactor 610 and ensure a deposition continuously or semi-continuously. The travel device may comprise a first mandrel 631 from which the fiber 640 is unwound, and a second mandrel 632 on which the coated fiber 640 is wound.

In the device 600, the characteristics of the laser beam 621 (for example its power or its wavelength) can be advantageously chosen to switch the coating precursor to the supercritical state only in the vicinity of the fiber segment 640 which is heated by the laser beam 621, and thereby ensure the formation of the coating on the heated fiber segment 640. The enclosure 601 can be controlled in temperature and in pressure to ensure the passage of the precursor to the supercritical state. Such a method and such a device 600 allow reducing the energy required to perform the deposition, while increasing the kinetics, the reproducibility and the homogeneity of the deposition. It will be noted that the different dispositions of the laser source presented for the devices in which a precursor is used in the liquid state can be applied similarly to the device 600.

Example 1

A pyrocarbon interphase (PyC) is deposited on a strand of silicon carbide (SiC) fibers by calefaction by using a device similar to the device 100 described above. The coating precursor in the liquid state is ethanol. The laser source is a 1,000 Watt Nd:YAG laser generating a laser beam with a wavelength on the order of 1,064 nm. The laser beam is focused at a point of the strand of fibers that travel continuously at a speed of 120 mm/min in the reactor.

A homogeneous interphase coating was thus obtained on the strand of fibers having a thickness of 0.3 μm.

Example 2

A pyrocarbon (PyC) interphase is deposited on a strand of silicon carbide (SiC) fibers by a supercritical method by using a device similar to the device 600 described above. The coating precursor to be used in the supercritical state which is introduced into the reactor is methane. The laser source is a 100 watt laser diode generating a laser beam with a wavelength on the order of 808 nm. The laser beam is focused at a point of the strand of fibers that travel continuously at a speed of 120 mm/min in the reactor.

A homogeneous interphase coating was thus obtained on the strand of fibers having a thickness of 0.3 μm.

The invention claimed is:

1. A method for depositing a coating on a continuous carbon or ceramic fiber from a precursor of the coating, the method being:

(i) a calefaction deposition method comprising: heating at least one segment of the fiber in the presence of a liquid phase of the coating precursor by a laser beam so as to bring the surface of the segment to a temperature allowing the formation of the coating on the segment from the coating precursor; or (ii) a method comprising: heating at least one segment of the fiber in the presence of a supercritical phase of the coating precursor by a laser beam so as to bring the surface of the segment to a temperature allowing the formation of the coating on the segment from the coating precursor.

2. The method according to claim 1, further comprising the travel of the fiber in front of the laser beam so as to form the coating on several successive fiber segments.

3. The method according to claim 1, wherein several distinct fiber segments are heated simultaneously by several laser beams.

4. The method according to claim 1, wherein a segment of the fiber is heated by several laser beams angularly distributed around said segment.

5. The method according to claim 1, wherein the coating is an interphase coating.

6. The method according to claim 1, wherein the coating comprises a material chosen among the following elements: silicon carbides, pyrocarbon, doped or undoped boron nitrides, doped or undoped silicon nitrides, boron carbides and mixtures thereof.

7. The method according to claim 1, wherein the fiber is made of silicon carbide.

8. The method according to claim 7, wherein the material of the fiber has an oxygen content of less than or equal to 1% in atomic percentage.

* * * * *